US007623807B2

(12) United States Patent
Carter, II et al.

(10) Patent No.: US 7,623,807 B2
(45) Date of Patent: Nov. 24, 2009

(54) DYNAMIC SEAL FOR COMPONENT SURFACES

(75) Inventors: James Anthany Carter, II, Lexington, KY (US); Jarrett Clark Gayne, Lexington, KY (US); Matthew Thomas Kerley, Lexington, KY (US); Michael David Lattuca, Lexington, KY (US); Benjamin Keith Newman, Lexington, KY (US); Keith Seaman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 39 days.

(21) Appl. No.: 11/304,444

(22) Filed: Dec. 15, 2005

(65) Prior Publication Data

US 2007/0140729 A1 Jun. 21, 2007

(51) Int. Cl.
*G03G 15/08* (2006.01)

(52) U.S. Cl. ..... 399/102; 399/103; 399/105

(58) Field of Classification Search ..... 399/102–105
See application file for complete search history.

(56) References Cited

U.S. PATENT DOCUMENTS

| | | | | |
|---|---|---|---|---|
| 3,809,012 | A | 5/1974 | Delvecchio | 118/637 |
| 3,985,436 | A | 10/1976 | Tanaka et al. | 355/8 |
| 4,218,131 | A | 8/1980 | Ito et al. | 355/15 |
| 4,400,082 | A | 8/1983 | Kiba | 355/15 |
| 4,498,760 | A | 2/1985 | Sugiyama | 355/15 |
| 4,500,195 | A | 2/1985 | Hosono | 355/3 |
| 4,540,268 | A | 9/1985 | Toyono et al. | 355/3 |
| 4,564,283 | A | 1/1986 | Fox et al. | 355/15 |
| 4,616,919 | A | 10/1986 | Adley et al. | 355/3 |
| 4,627,701 | A | 12/1986 | Onoda et al. | 355/3 |
| 4,681,426 | A | 7/1987 | Bean et al. | 355/15 |
| 4,779,119 | A | 10/1988 | Kaieda | 355/15 |
| 4,791,454 | A | 12/1988 | Takahashi et al. | 355/15 |
| 4,802,928 | A | 2/1989 | Dunlap | 134/15 |
| 4,819,030 | A | 4/1989 | Shibano | 355/15 |
| 4,862,209 | A | 8/1989 | Sakamoto et al. | 355/211 |
| 4,870,449 | A | 9/1989 | Brown | 355/297 |
| 4,893,151 | A | 1/1990 | Yamazaki | 355/245 |
| 4,905,047 | A | 2/1990 | Ariyama | 355/256 |
| 4,937,632 | A | 6/1990 | Kamidaira | 355/299 |
| 4,947,216 | A | 8/1990 | Surti | 355/299 |
| 5,021,830 | A | 6/1991 | Koiso | 355/215 |
| 5,029,316 | A | 7/1991 | Koiso | 355/299 |
| 5,202,729 | A | 4/1993 | Miyamoto et al. | 355/251 |
| RE34,384 | E | 9/1993 | Ishiguro et al. | 355/298 |
| 5,321,473 | A | 6/1994 | Azami | 355/245 |
| 5,369,477 | A | 11/1994 | Foote et al. | 355/256 |
| 5,404,216 | A | 4/1995 | Numagami et al. | 355/296 |
| 5,455,665 | A | 10/1995 | Baba et al. | 355/298 |
| 5,475,467 | A | 12/1995 | Watanabe et al. | 355/200 |
| 5,488,462 | A | 1/1996 | Ishikawa et al. | 355/215 |
| 5,502,547 | A | 3/1996 | Shirai | 355/215 |
| 5,550,617 | A | 8/1996 | Odagawa et al. | 355/210 |
| 5,585,895 | A | 12/1996 | Yashiro et al. | 355/215 |

(Continued)

*Primary Examiner*—David M Gray
*Assistant Examiner*—Erika Villaluna
(74) *Attorney, Agent, or Firm*—Steven J. Grossman; John Victor Pezdek

(57) ABSTRACT

The present invention relates to seals which may be used in an image forming apparatus. The seals may prevent the leakage of image forming materials, e.g. as between a blade or a roll and an image forming apparatus housing.

24 Claims, 9 Drawing Sheets

U.S. PATENT DOCUMENTS 5,655,178 A 8/1997 Ishikawa et al. ..... 399/102
5,697,021 A 12/1997 Watanabe et al. ..... 399/102
5,697,022 A 12/1997 Matsuda et al. ..... 399/102
5,701,558 A 12/1997 Kojima ..... 399/103
5,758,230 A 5/1998 Nakaue et al. ..... 399/103
5,774,765 A 6/1998 Hirota et al. ..... 399/102
5,778,282 A 7/1998 Nagashima ..... 399/106
5,805,958 A 9/1998 Fisk ..... 399/98
5,805,965 A 9/1998 Tsuda et al. ..... 399/281
5,809,374 A 9/1998 Tsuda et al. ..... 399/111
5,870,651 A 2/1999 Shimada ..... 399/102
5,895,144 A 4/1999 Nishimura ..... 399/104
5,895,151 A 4/1999 Kinoshita et al. ..... 399/284
5,937,237 A 8/1999 Nonaka et al. ..... 399/106
5,946,530 A * 8/1999 Tsuji et al. ..... 399/103
5,987,277 A 11/1999 Okabe ..... 399/103
5,995,774 A 11/1999 Applegate et al. ..... 399/27
6,009,285 A 12/1999 Barry et al. ..... 399/12
6,035,158 A 3/2000 Asakura et al. ..... 399/101
6,049,689 A 4/2000 Ishii et al. ..... 399/284
6,071,660 A 6/2000 Black et al. ..... 430/59.6
6,078,763 A 6/2000 Hoshi ..... 399/111
6,094,550 A 7/2000 Kido et al. ..... 399/103
6,115,565 A 9/2000 Noda ..... 399/102
6,178,301 B1 1/2001 Kojima et al. ..... 399/98
6,181,897 B1 1/2001 Kawai ..... 399/103
6,185,392 B1 2/2001 Hoshi ..... 399/102
6,195,515 B1 2/2001 Fujita et al. ..... 399/103
6,205,304 B1 3/2001 Kawaguchi ..... 399/103
6,212,343 B1 4/2001 Hosokawa et al. ..... 399/102
6,341,206 B1 1/2002 Yamaguchi et al. ..... 399/103
6,487,383 B2 * 11/2002 Buchanan et al. ..... 399/103
6,553,195 B2 4/2003 Korfhage et al. ..... 399/102
6,643,481 B2 11/2003 Higeta et al. ..... 399/109
6,690,900 B2 2/2004 Dougherty et al. ..... 399/103
6,842,595 B1 1/2005 McIver et al. ..... 399/106

* cited by examiner

DYNAMIC SEAL FOR COMPONENT SURFACES

FIELD OF THE INVENTION

The present invention relates to seals which may be used in an image forming apparatus. The seals may prevent the leakage of image forming materials, e.g., as between components and a housing in the image forming device. The image forming apparatus may include an electrophotographic device, ink printer, copier, fax, all-in-one device or multi-functional device

BACKGROUND OF THE INVENTION

An image forming device, such as an electrophotographic device, ink printer, copier, fax, all-in-one device or multi-functional device may use developing agents such as toner or ink, which are stored in a cartridge and may be disposed on media to form an image. The developing agent, such as toner, may be fixed to the media using an image fixing apparatus, which may apply heat and/or pressure to the toner. Leakage of the toner from the cartridge may occur as it may be difficult to seal gaps between a rotating roll, a cleaning or doctor blade and the housing of the cartridge. Seals may be provided to effectively close the gaps and prevent toner leakage. Positioning of the roll against the seal and tolerance stack-up of the various mating components may create uneven stress and a non-uniform temperature profile. At higher printing speeds, heat may be generated due to the compression of the seal against the rotating roll causing the toner to melt. Design of the seal may therefore be an important factor in cartridge life.

SUMMARY OF THE INVENTION

In a first exemplary embodiment, the present invention is directed at a sealing member for sealing between printer components. The sealing member includes a first surface to be engaged with one of the components and a second surface capable of biasing the first surface to engage with the component. The biasing may result in the development of a contact pressure as between the first surface of the seal and the component and the contact pressure may also be substantially uniform as between the first surface of the seal and the component.

In a second exemplary embodiment the present invention is directed at a sealing member for sealing between printer components. The seal includes a first surface to be engaged with one of the components and a second surface capable of biasing the first surface to frictionally engage with the printer component thereby developing a temperature wherein the temperature between the first surface of the seal and the printer component may be substantially uniform.

In a third exemplary embodiment the present invention is directed at a sealing member for sealing between printer components. The seal includes a first surface capable of engaging with a surface of one of the printer components wherein the first surface includes one or a plurality of grooves. The grooves may include a wall component that is capable of forming an angle greater than 45 degrees and less than 135 degrees when engaged with the surface of the printer component.

BRIEF DESCRIPTION OF THE DRAWINGS

The detailed description below may be better understood with reference to the accompanying figures which are provided for illustrative purposes and are not to be considered as limiting any aspect of the invention.

DETAILED DESCRIPTION OF THE INVENTION

The present invention relates to seals which may be used between component surfaces, such as component surfaces in an image forming apparatus. The seals may prevent the leakage of image forming materials, e.g. as between a blade and a housing or between a roll and a housing in the image forming apparatus. The blade may be a "doctor blade" which may control the thickness of image forming material on a given surface, such as a roll surface. The roll may specifically include a developer roll which supplies image forming material (toner) to a photosensitive drum.

Figure 1:
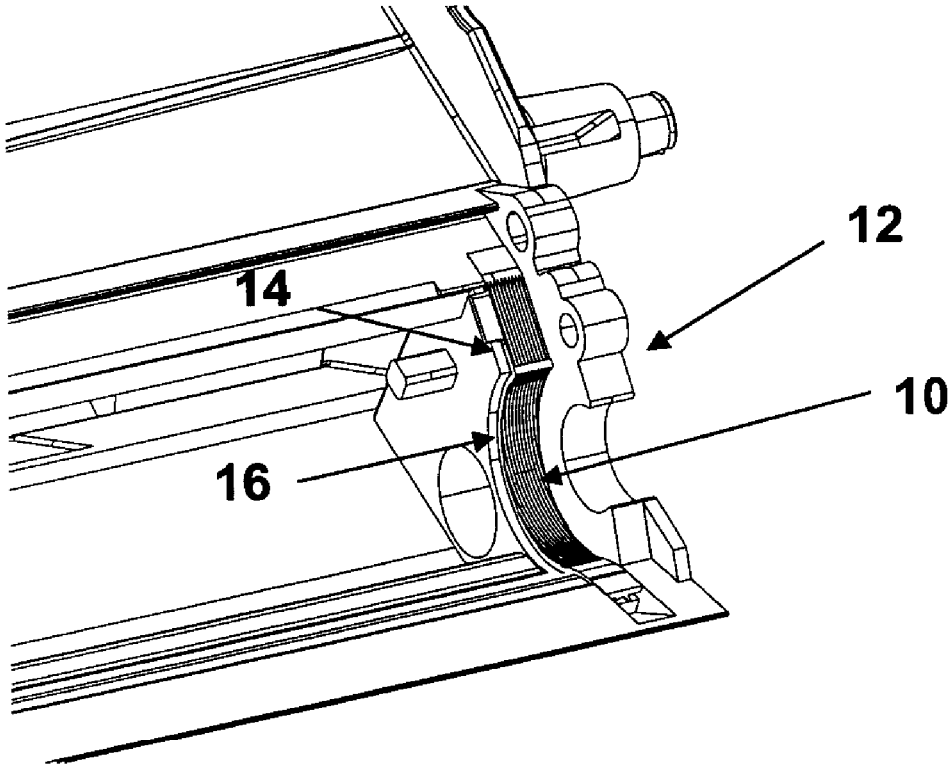
FIG. 1 is a view of an exemplary seal within an exemplary housing.
Figure 2:
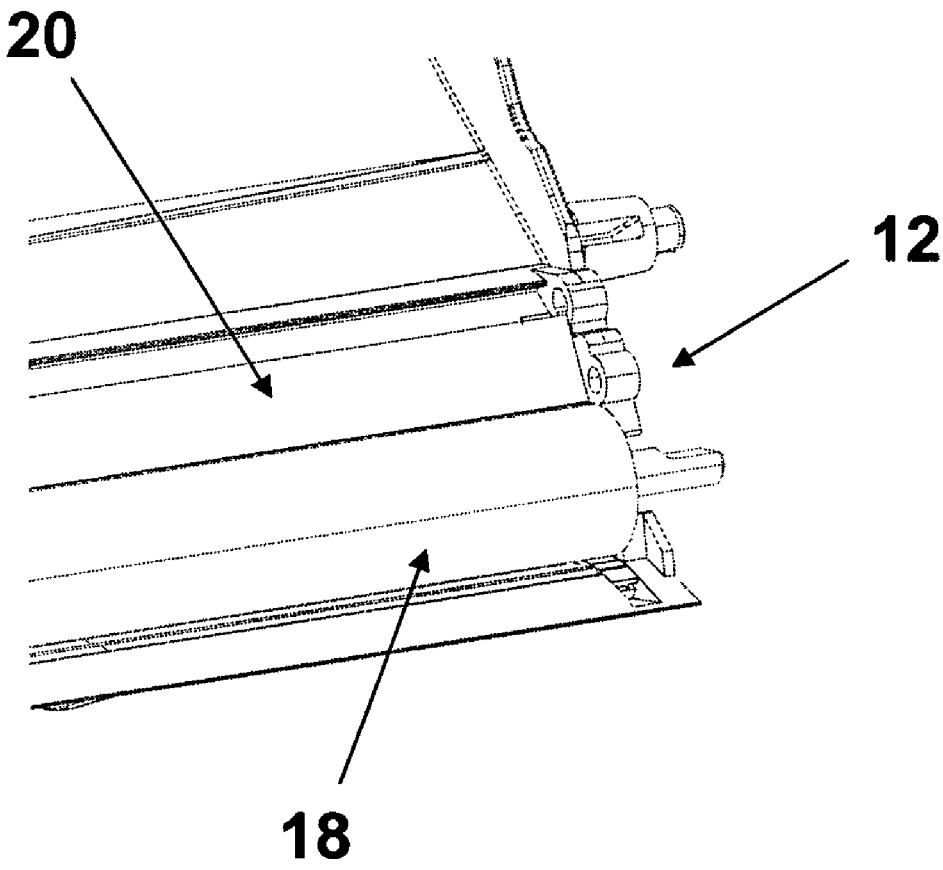
FIG. 2 is a view of an exemplary seal (hidden) in an exemplary housing.
Figure 3:
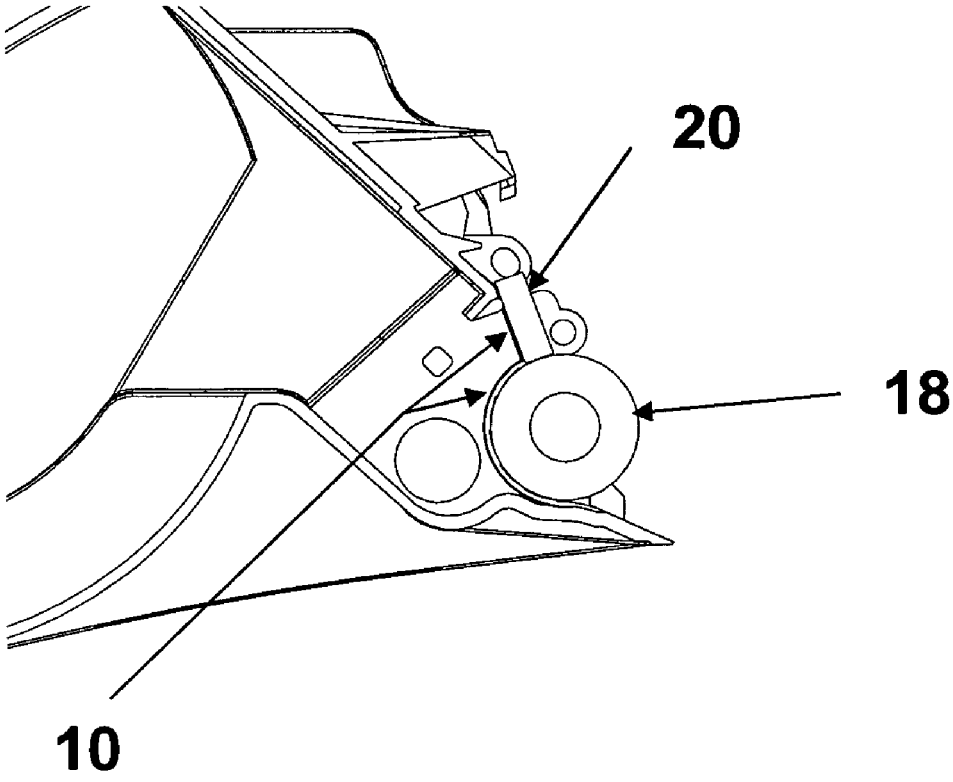
FIG. 3 is a sectional view of the exemplary seal in an exemplary housing.

With reference first to FIG. 1, an exemplary seal 10 is illustrated that may be disposed in the housing 12 of a cartridge of image forming apparatus. The seal 10 may be compressed between a mating surface 14 formed in the housing and a portion of a doctor blade (not shown). The seal may also be compressed between a curved mating surface 16 formed in the housing 12 and a portion of a cylindrical developer roll (not shown). FIG. 2 is a front view showing placement of the exemplary developer roller 18 and doctor blade 20. FIG. 3 is a side view of the seal 10 in the housing as well as developer roll 18 and doctor blade 20.

The interference of the roll or blade to the seal may be determined by the position of the roll and blade, respectively. Depending on the amount of interference, which may be due primarily to the positioning and/or to the tolerance stack-up of various components, higher speeds of printing may result in high temperatures and melting of the toner. This build-up of heat may be further exacerbated by the composition of the roll surface and seal, often both relatively soft elastomers. Melted toner may then wedge between the doctor blade and developer roll which may lead to printer malfunction or failure.

Figure 4:
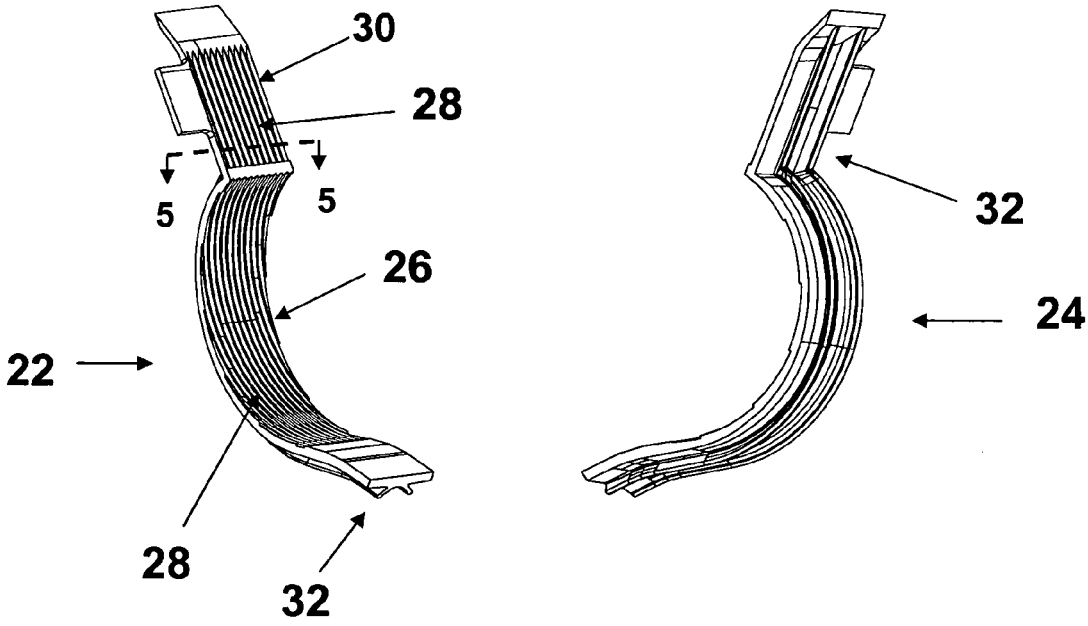
FIG. 4 includes front and back views of an exemplary seal of the present invention.

FIG. 4 illustrates a more detailed illustration of the front sealing surface 22 and back surface 24 of the exemplary seal 10. The seal may comprise a molded (e.g., injection molded or compression molded) part made of a polymeric based elastomeric material. One suitable material is Santoprene™ thermoplastic vulcanizate which provides performance similar to vulcanized rubber, such as flexibility (e.g., 35 Shore A to 50 Shore D including all increments and values therebetween). In addition, the seal material may have relatively low compression set along with the processing capability of a thermoplastic resin. In addition, the material selected for the seal may provide continued sealing performance through heat and cold (−60° C. to 135° C.) along with resistance to fatigue, as well as oils, greases and a variety of acids and base compounds.

As can be seen, the seal may include a rotary seal portion 26 which may seal the space formed between the housing 12 and rotary member or developer roller 18. The sealing face of the rotary seal portion which is adjacent to the surface of the rotary member is shown in FIG. 4 and may include what may be described as sawtooth type ribs forming grooves 28. Within the rotary seal portion the grooves 28 may run at an angle to the process direction of the rotary member 18, generally the developer roll, at angles ranging from about 1 degree to about 45 degrees (preferably about 10 degrees). The grooves may therefore be arranged to move toner from the end of the roll toward the middle. By positioning the grooves in this way, they may act to push toner away from the end of the developer roll. The height of the ribs forming the groove generally may range from about 0.05 to about 0.5 mm, preferably about 0.1 mm, including all values and increments therein. The width of the ribs generally may range from about 0.01 to about 0.5 mm, preferably about 0.2 mm, also including all values and increments therein.

The seal 10 also may includes a blade seal portion 30 for sealing the space formed between the frame member or cartridge housing 12 and the blade member 20 in an image forming apparatus. The blade seal portion 30 of the seal 10 may be generally formed such that it is held in place between the blade member and the frame member when positioned in use.

Figure 5:
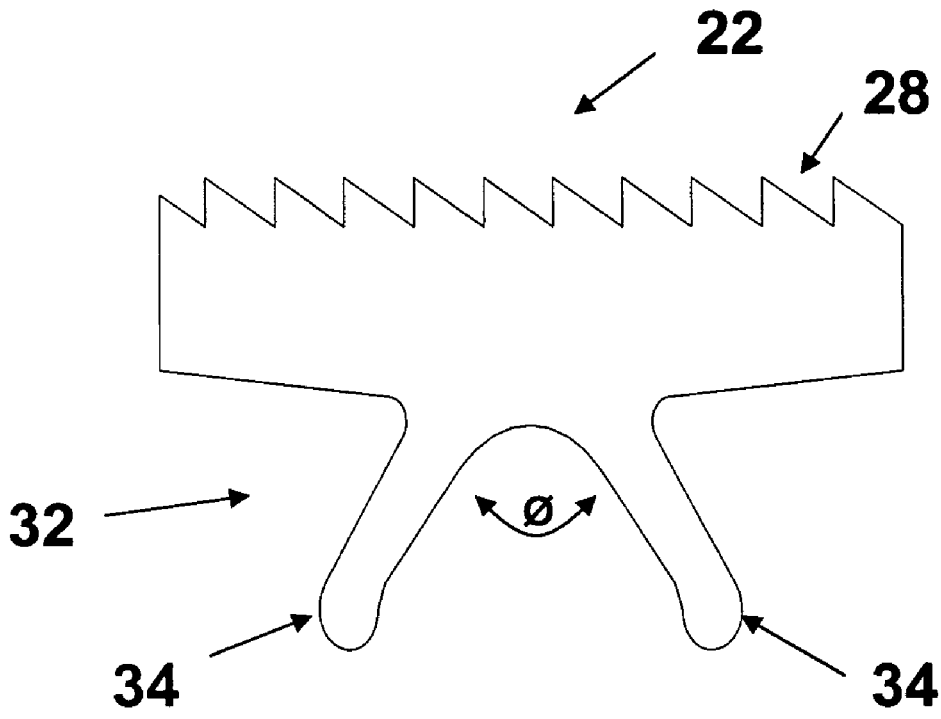
FIG. 5 is a cross-sectional view of the seal of FIG. 4 along line 5-5.

The seal 10 herein may include a biasing feature 32 which may run along all or a portion of the back surface 24. Such biasing, when experienced between the housing 12 and roll 18 and/or as between the housing 12 and blade 20 may therefore bias the seal 10 toward and against such exemplary components. As can be seen in FIG. 5, which represents a cross-sectional view along the lines 5-5 in FIG. 4, the biasing may be developed by a pair of what may be described as generally v-shaped or u-shaped ribs 34 which may extend from the back surface 24 of the seal 10. The ribs may therefore define an angle Ø which may have a value of between about 1-179 degrees, including all values and increments therebetween. For example, Ø may have a value of between about 30-160 degrees. In addition, in the exemplary illustration, the ribs 34 may be positioned such that they do not converge toward one another when projecting from the back surface of the seal.

Accordingly, biasing feature 32 may specifically include a pair of rib structures that extend from all or the entirety of the length of back surface 24 of the seal 10 (see FIG. 4) and which may therefore bias or maintain the seal against the rotary member 18 without impairing its rotation. In addition, biasing feature 32 may also maintain the seal against the blade 20 without impairing its ability to serve as a doctor blade during printing. Furthermore, it can be appreciated that the biasing feature herein may provide biasing over a full range of part tolerances.

It is also worth noting that the biasing feature of the present invention may implicate other useful performance attributes. This may be illustrated by a finite element analysis of the seal 10 as presented in FIGS. 6 and 7. Such finite element analysis may be provided by ANSYS Mechanical™ software, available from ANSYS, Inc., Canonsburg, Pa.

Figure 6:
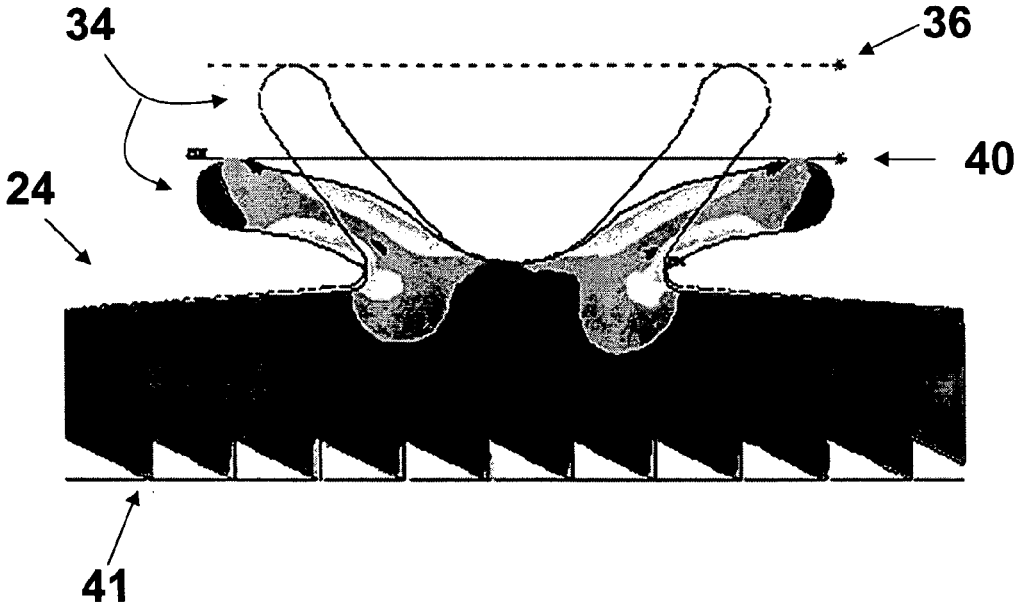
FIG. 6 is a finite element analysis (Von Mises Strain Plot) of a cross-section of the seal as between an unbiased and biased configuration.

With attention first directed to FIG. 6, a Von Mises Strain Plot is shown illustrating in general the propagation of strain through the cross-section of the seal 10 as between configuration 36 (unbiased) and configuration 40 (biased). In FIG. 6, generally, darker shaded regions indicate those areas of relatively higher strain and lighter shading identifies areas of relatively reduced strain. As can be observed, the strain does not substantially propagate to a representative sealing surface 41. That is, the strain from the flexing of the ribs 34 does not substantially propagate and emerge more prominently at isolated locations on the grooved surface 41 relative to other locations on the grooved surface. In addition, the strain from the flexing of the ribs 34 may not reach the sawtooth ribs. This may provide that the deflection of the ribs 34 on one side of the seal becomes substantially independent of the sawtooth ribs on the other side of the seal. As a result, and as discussed more fully below with respect to FIG. 7, the contact pressure along the sawtooth ribs may be more uniformly distributed.

Figure 7:
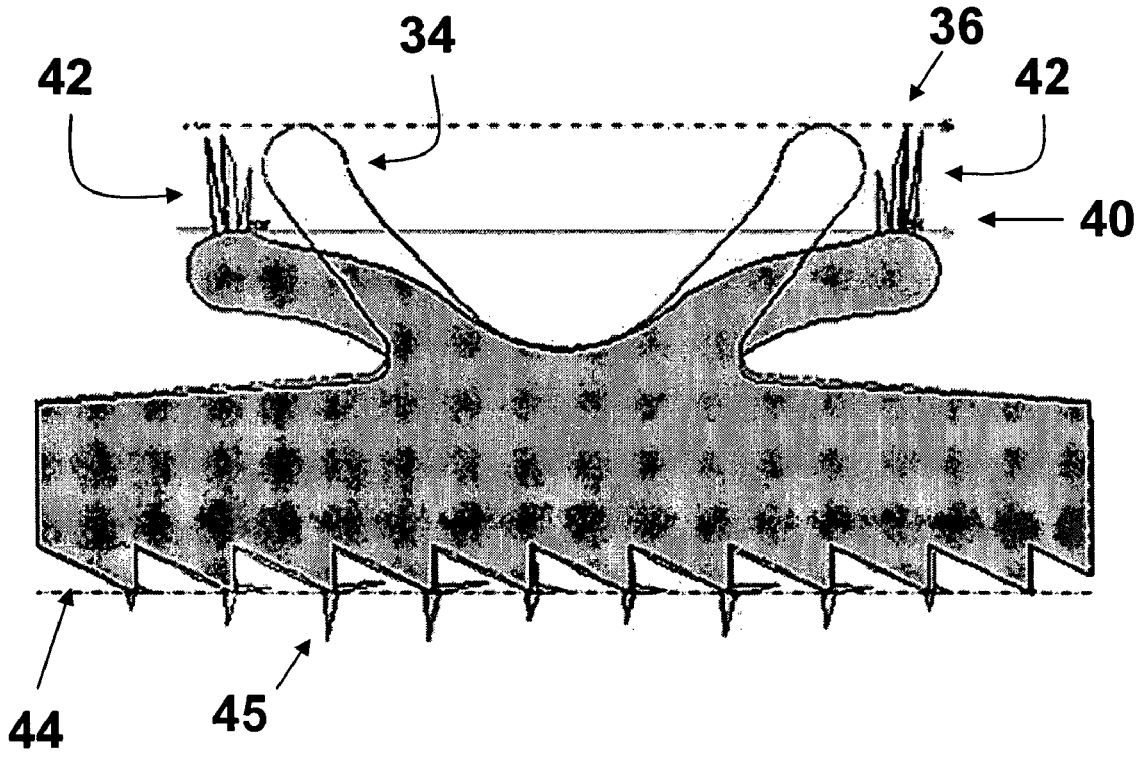
FIG. 7 is a finite element analysis (Contact Pressure Distribution Plot) of a cross-section of the seal as between an unbiased and biased configuration.

Accordingly, FIG. 7 provides a contact pressure distribution plot illustrating in general the contact pressure along the corresponding sealing surface 44, as between configuration 36 (unbiased) and configuration 40 (biased). In FIG. 7 a relatively high contact pressure can be seen at region 42 (indicated by the multiple peaks) when the seal is in a biased condition. However, the corresponding distribution of contact pressure along representative sealing surface 44 (indicated by the projecting peaks 45) appears well distributed along the entire part and may be substantially uniform. That is, the contact pressure on sealing surface 44 does not provide isolated locations or regions where contact pressure may otherwise tend to significantly spike relative to other regions on the sealing surface. For example, the total contacting pressure provided by the sealing surface engaged with a component surface may result in a particular psi value. Accordingly, at any particular point, location or region along such sealing surface, the pressure may now be controlled to about +/−15% of the total contacting pressure.

Figure 8:
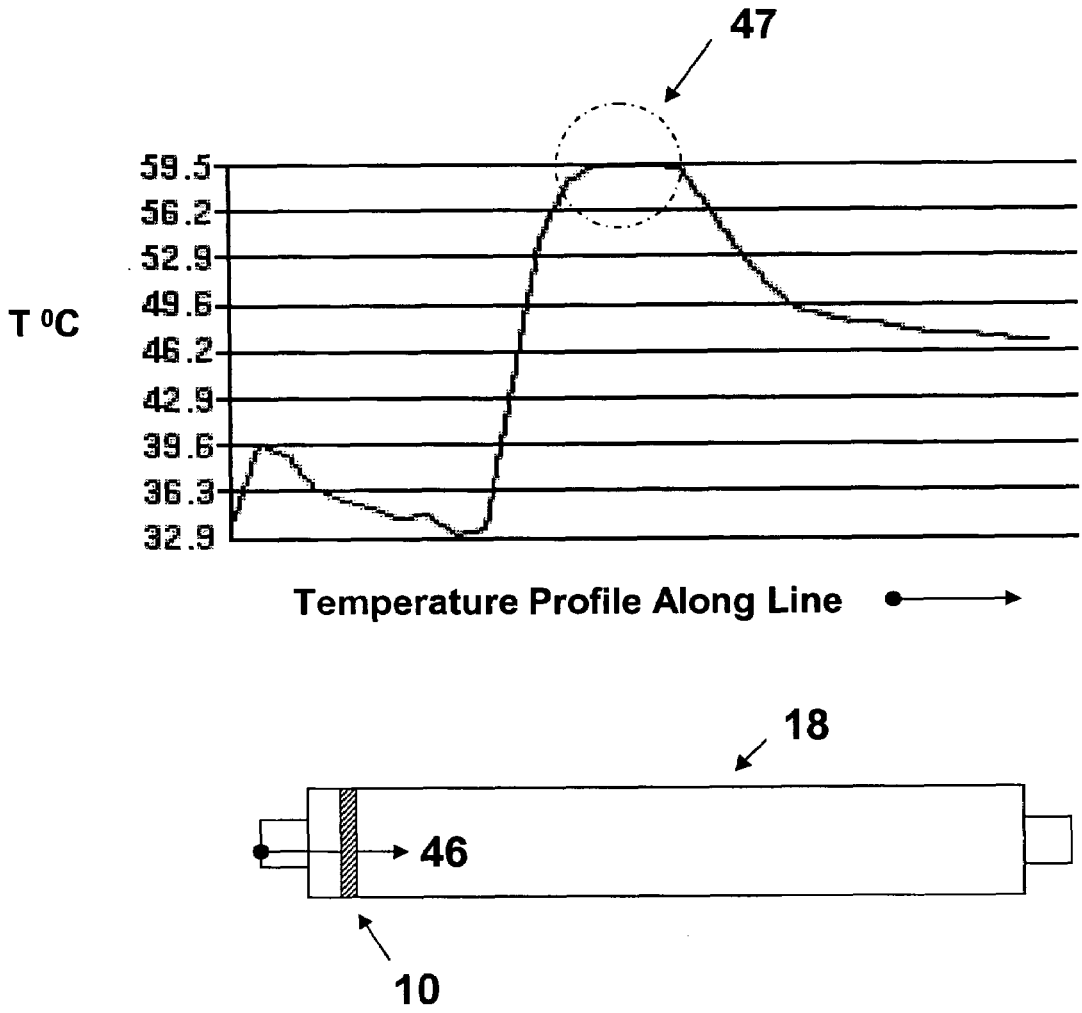
FIG. 8 shows the results of thermal imaging of an exemplary roller in combination with an exemplary seal.

It can now be appreciated that the seal of the present invention may therefore provide a more uniform temperature distribution as between, e.g., the developer roller 18 and seal 10, particularly at relatively high printing speeds. More precisely, by controlling and providing substantially uniform contact pressure along the sealing surface as between the seal 10 and developer roller 18, encroachment upon temperatures that would be sufficient to initiate melting or some level of flow of any one or more of the constituents of the toner (e.g., polymer resin, colorant, wax, inorganic salts) may be avoided. Attention is therefore directed to FIG. 8 which shows the results of thermal imaging of an exemplary developer roller 18 along the indicated line 46 as one proceeds from the outer edge of the roller across the seal 10 and towards the center of the roller. As can be seen, at the outer edge of the roller the temperatures range between about 32-40° C. As one approaches and evaluates the temperature across the seal 10, where the seal may be in frictional engagement with the roller, the temperature peaks to about 59.5° C. and remains substantial uniform as shown at region 47. The temperature then drops to fall within the range of about 46-49° C. as one proceeds to the interior portions of the roller. Accordingly, at the contacting surfaces as between the seal 10 and the roller, the temperature may remain substantially uniform, and may vary between about 0-5° C., including all values and increments therebetween.

Figure 9:
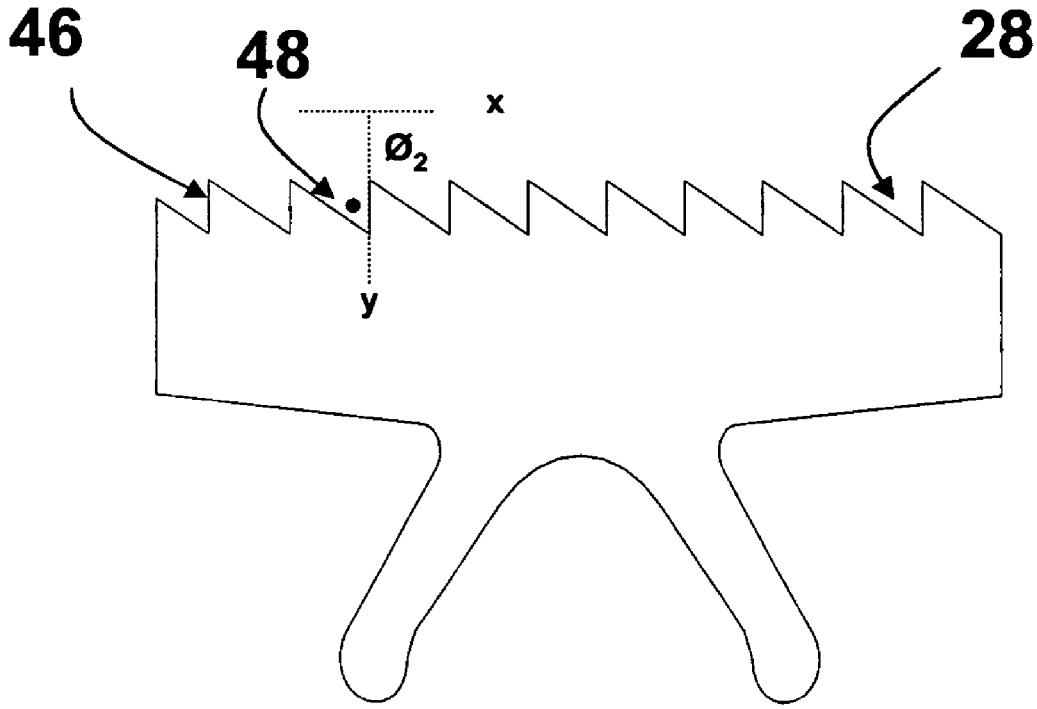
FIG. 9 is another cross-sectional view of the seal of FIG. 4 along line 5-5.

Finally, attention is directed to FIG. 9 which is yet another cross-sectional view of the seal 10 as in FIG. 4. As can be seen the grooves may include one or a plurality of substantially vertical wall components 46 which may engage with a surface of blade 20 and/or developer roller 18. As illustrated, wall components 46 may form a substantially perpendicular angle $Ø_2$ when projecting the vertical wall component in a "y" direction and intersecting an "x" plane. The "x" plane may therefore be representative of a sealing surface. However, in the context of the present invention, $Ø_2$ may be any angle greater than 45 degrees and less than 135 degrees, including all increments and values therebetween. For example, for a substantially vertical wall component, $Ø_2$ may have a value of between 75-105 degrees, or may have a specific value of about 90 degrees. In addition, it has been found that such a wall design, when utilized in a printer containing toner, and engaging a developer roller surface, may better serve to resist migration of toner 48 between the grooves away from the toner sump which thereby may further limit toner leakage.

Although the seals of the present invention have been illustrated using the specific embodiments described herein, the present invention is intended to encompass the seals as broadly described herein, including all equivalent structures of those specifically described in the present application. However, it should be apparent that changes and modifications may be resorted to without departing from the spirit and scope of the invention.

What is claimed is:

1. A sealing member for sealing between printer components comprising:

a first surface to be engaged with one of said components with a contact pressure wherein said first surface includes one or a plurality of grooves;

a second surface capable of biasing said first surface to engage with said component wherein said biasing is capable of providing a substantially uniform contact pressure between said first surface and said component wherein said second surface capable of biasing said first surface comprises a pair of projecting ribs which define an angle between said projecting ribs of about 1-179 degrees.

2. The sealing member of claim 1 wherein said pair of projecting ribs define an angle between said projecting ribs of about 30-160 degrees.

3. The sealing member of claim 1, wherein said first surface of said sealing member upon engaging with said component provides a total contacting pressure, and said contact pressure at any location along said first surface varies between about 0-15% of said total contacting pressure.

4. The sealing member of claim 1 wherein said printer components comprise a roller and a housing and said first surface engages said roller and said second surface engages said housing.

5. The sealing member of claim 1 wherein said sealing member includes a rotary seal portion for engaging a roller and a blade seal portion for engaging a doctor blade.

6. The sealing member of claim 1 wherein said component has a surface and said first surface of said seal includes one or a plurality of grooves including a wail component and wherein said wall component is capable of forming an angle greater than 45 degrees and less than 135 degrees when engaged with said surface of said component.

7. The sealing member of claim 1 wherein said second surface of said seal when biasing said first surface of said seal to frictionally engage wit said component develops a temperature wherein said temperature between said first surface of said seal and said component is substantially uniform.

8. The sealing member of claim 1 located within a printer cartridge.

9. The sealing member of claim 1 located within an image forming apparatus.

10. A sealing member for sealing between printer components comprising:

a first surface to be engaged with one of said components wherein said first surface includes one or a plurality of grooves;

a second surface capable of biasing said first surface to frictionally engage with said component and developing a temperature wherein said temperature between said first surface of said seal and said component is substantially uniform wherein said second surface capable of biasing said first surface comprises a pair of projecting ribs which define an angle between said projecting ribs of about 1-179 degrees.

11. The sealing member of claim 10 wherein said temperature between said first surface and said component varies between about 0-5° C.

12. The scaling member of claim 10, wherein said component is a roller and said first surface of said sealing member is capable of frictionally engaging said roller.

13. The sealing member of claim 10 wherein said pair of projecting ribs define an angle between said projecting ribs of between about 30-160 degrees.

14. The sealing member of claim 10 wherein said first surface of said seal includes one or a plurality of grooves including a wall component and wherein said wall component is capable of forming an angle greater than 45 degrees and less than 135 degrees when engaged with said surface of said component.

15. The sealing member of claim 10 wherein the temperature is at or below about 60° C.

16. The sealing member of claim 10 located within a printer cartridge.

17. The sealing member of claim 10 located within an image forming apparatus.

18. A sealing member for sealing between a developer roller and other printer cartridge components, comprising:

a first surface capable of engaging with a surface of said developer roller wherein said first surface includes one or a plurality of grooves, said grooves having a substantially vertical wall component of between about 75 degrees to about 105 degrees and a non-vertical wall component intersecting said substantially vertical wall component; and a second surface capable of biasing said first surface to engage with said developer roll wherein said biasing is capable of providing a substantially uniform contact pressure between said first surface and said developer roil wherein said second surface capable of biasing said first surface comprises a pair of projecting ribs which define an angle between said projecting ribs of about 1-179 degrees.

19. The sealing member of claim 18 wherein said printer components comprise a housing and said pair of projecting ribs engage said housing.

20. The sealing member of claim 18 wherein said developer roller has an end and said grooves are capable of directing image forming media away from the end of said roller when in use.

21. The sealing member of claim 18 located within a printer cartridge.

22. The sealing member of claim 18 located within an image forming apparatus.

23. A sealing member for sealing between a developer roller and a printer cartridge housing comprising:

a first surface capable of engaging with a surface of said developer roller wherein said first surface includes one or a plurality of grooves wherein said developer roller has an end and said grooves are capable of directing image forming media away from the end of said developer roller when in use; and a second surface capable of biasing said first surface to engage with said developer roll wherein said biasing is capable of providing a substantially uniform contact pressure between said first surface and said developer roll wherein said second surface capable of biasing said first surface comprises a pair of projecting ribs which define an angle between said projecting ribs of about 1-179 degrees and sealingly engage said printer cartridge housing.

24. The sealing member of claim 23 wherein said grooves have a substantially vertical wall component of between about 75 degrees to about 105 degrees.

* * * * *